US007298981B2

(12) United States Patent
Oohara et al.

(10) Patent No.: US 7,298,981 B2
(45) Date of Patent: Nov. 20, 2007

(54) FIXING DEVICE AND IMAGE FORMING APPARATUS WITH GUIDE HAVING ADJUSTABLE BIASING ANGLE

(75) Inventors: Shunichi Oohara, Ushiku (JP); Hiroyuki Seki, Hitachi (JP); Toshio Ogiso, Hitachi (JP); Shigeru Obata, Ishioka (JP); Chikara Hiraoka, Hitachi (JP); Toru Hanashima, Hitachi (JP); Kazuhiro Wakamatsu, Hitachi (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 194 days.

(21) Appl. No.: 11/175,134

(22) Filed: Jul. 7, 2005

(65) Prior Publication Data

US 2006/0008283 A1 Jan. 12, 2006

(30) Foreign Application Priority Data

Jul. 7, 2004 (JP) ..... 2004-200137

(51) Int. Cl.
*G03G 15/00* (2006.01)

(52) U.S. Cl. ..... 399/45; 399/322; 399/406

(58) Field of Classification Search ..... 399/45, 399/322, 323, 328, 329, 406
See application file for complete search history.

(56) References Cited

U.S. PATENT DOCUMENTS 5,978,645 A * 11/1999 Miyazaki ..... 399/406

FOREIGN PATENT DOCUMENTS

| | | |
|---|---|---|
| JP | 10-228198 | 8/1998 |
| JP | 2000-352887 | 12/2000 |
| JP | 2003-295657 | 10/2003 |

* cited by examiner

*Primary Examiner*—Hoang Ngo
(74) *Attorney, Agent, or Firm*—Antonelli, Terry, Stout & Kraus, LLP.

(57) ABSTRACT

A fixing device includes a first fixing part having a heater disposed therein, a second fixing part, disposed to oppose to the first fixing part, for pinching a recording medium to form a first nip portion, a pair of transfer rollers, disposed at a downstream side of the recording medium, for forming a second nip portion, a guide for biasing the recording medium discharged from the transfer rollers towards the first fixing part side from one of the transfers rollers, and means part for biasing the guide towards the recording medium side.

11 Claims, 3 Drawing Sheets

FIXING DEVICE AND IMAGE FORMING APPARATUS WITH GUIDE HAVING ADJUSTABLE BIASING ANGLE

CLAIM OF PRIORITY

This application claims priority from Japanese Application Ser. No. 2004-200137, filed on Jul. 7, 2004, the content of which is incorporated by reference into this application.

FIELD OF THE INVENTION

The present invention relates to a fixing device for an electrophotographic type image forming apparatus and an image forming apparatus using the fixing device.

RELATED ART

In a fixing device using a belt, only an image forming side of the belt is heated so as to shorten a rise time to a temperature at which fixing can be done. In such case, since a temperature at the non-heating side just after the rising does not elevate to a desired temperature and since heat is adsorbed in a recording medium when the recording medium is continuously supplied, a temperature difference between the heated side and the non-heated side (the image forming side and the non-image forming side) becomes large. This temperature difference accelerates curling of the recording medium. The degree of curling depends on brands of recording media. Further, it depends on water adsorption degree in the recording media. In general, the larger the water adsorption, the larger the curling becomes large.

When in order to remove curling of the non-image forming side, the recording medium is bent towards the direction of winding of the recording medium with respect to the belt or roller, the recording medium wreaths around the roll or brings about offset where a toner for forming the image adheres again to the heated belt or roller may take place. Therefore, it is difficult to remove curling effectively by bending the recording medium strongly just after the heated belt or the heated roller; in the case where curling of a recording medium with a high water content is large, curling can not be removed sufficiently. On the other hand, if a decurl mechanism is disposed to remove curling at a position after the recording medium has passed through the fixing device, the temperature of the recording medium lowers and reformation of the recording medium is difficult, it is necessary to deform the recording medium more greatly. This leads to clogging of the recording medium in the fixing device.

As disclosed in Patent document No. 1, a device for removing curling of the recording medium is proposed wherein a belt member has a heating member therein, a nip is formed between a pressure roll and the belt, and the recording medium is bent by pressing it towards a guide in the recording medium transferring direction at the nip exit. In this technology, since the end of the recording medium that has passed through a contact face between a discharging roller and a discharging runner is open, there is a fear that the curling is not removed sufficiently depending on kinds or quality of recording media.

In Patent document No. 2, there is disclosed a technology wherein a pressing roll with a small diameter for restricting curling is pushed towards a heat roll to transfer the recording medium along the guide face of the curling restriction member. Further, it is disclosed in the Patent document No. 2 a technology wherein a position of the curling restriction member is optimized by detecting a recording medium pressure. In these technologies, there is a fear that decurling is not surely done because the recording medium is in an open state during the transfer by the curling restriction member. Since the recording medium should be withdrawn at a speed slightly faster than a speed of the fixing roll after transfer from the fixing roll for the purpose of decurling. It should be difficult to do in the technology disclosed in Patent document No. 2.

Further, in Patent document No. 3, a decurler comprising a transfer roll and a pressing member to be pressured towards the transfer roller; curling is removed of the recording medium by utilizing the contact face between the transfer roller and the decurler. The traveling speed of the recording medium, i.e. a rotating speed of a nip portion between the transfer roller and the decurler must be larger than the speed of the recording medium at the fixing roller; it is considered to be difficult to increase the speeds of the transfer roller and the decurler, because the contact resistance in the contact face between the transfer roller and the decurler is large.

Patent document No. 1; Japanese patent laid-open 2000-352887

Patent document No. 2; Japanese patent laid-open 10-228198

Patent document No. 3; Japanese patent laid-open 2003-295657

SUMMARY OF THE INVENTION

It is an object of the present invention to provide a fixing device that is capable of surely removing curling of the recording medium after a fixing step in accordance with qualities of various recording media and also to provide an image forming apparatus using the fixing device.

The present invention provides a fixing device comprising first fixing means having a heating member therein, second fixing means, disposed in an opposite relation to the first fixing means, for forming a first nip portion by pinching a recording medium, a pair of transfer rollers, disposed downstream of the recording medium, for forming a second nip portion, a guide for biasing the recording medium discharged from the transfer rollers towards the first fixing means, and means for biasing the guide towards the recording medium side.

BRIEF DESCRIPTION OF DRAWINGS

FIG. 2(*a*) is a plan view of a divided roller and a decurl guide, and FIG. 2(*b*) a plan view of a roller that is opposite to the divided roller to form a second nip portion.

DETAILED DESCRIPTION OF THE PREFERRED EMBODIMENTS

Figure 1:
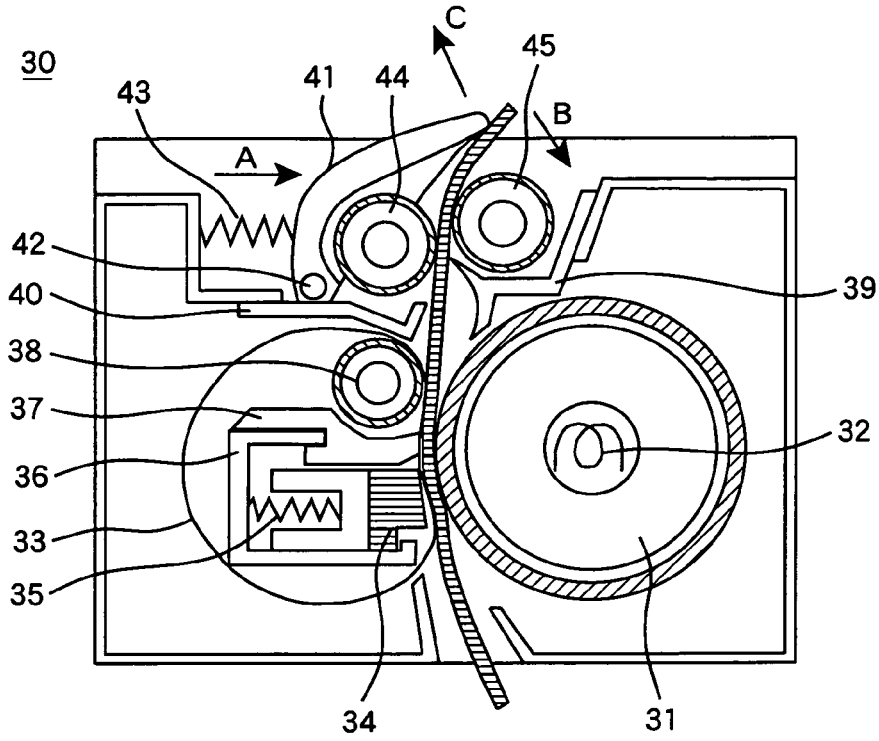
FIG. 1 is a side cross sectional view of a diagram of a fixing device according to an embodiment.

Reference numerals in the drawings are:

1; an image forming apparatus, 2; an intermediate transfer belt, 3; a photosensitive belt, 4; a driving roller, 5; a driving motor, 7; a photosensitive member side roller, 8; a motor driver, 9; a calculating means, 10; a recording medium cassette, 15; a developing unit, 16; a retract means, 18; fur brush, 19; a developing roller, 21; a sensor, 22; a transfer side roller, 23; an intermediate tension belt roller, 24; an intermediate transfer belt, 30; a fixing device, 31; a heat roller, 32; a heating member, 33; a fixing belt, 34; a first pad, 35; a first pad pressure spring, 36; a pressure stay, 37; a second pad, 38; a pressure roller, 41; a decurl guide, 44; a non-image side decurl roller, 45; an image forming side decurl guide, 151, 152, 153, 154; developing units.

The transfer rollers of the fixing device according to the present invention transfer the recording medium and perform necessary decurling at the same time.

Further, the fixing device may be provided with means for adjusting a biasing angle of the guide. Further, the fixing device may be provided with means for adjusting a biasing angle of the guide by detecting a thickness or a weight of the recording medium. The fixing device may be provided with means for adjusting a position of the second nip portion, formed by the pair of the transfer rollers, with respect to the first nip portion. The second nip portion is preferably located at a position closer to the first fixing device than is the first nip portion.

The present invention provides a fixing device comprises a heat roller having a heating element therein and driven rotatably, a belt pressed by a pressure member towards the heat roller, an image forming side decurl roller, a non-image side decurl roller, the decurl rollers being disposed to oppose to each other at a position downstream of the first nip portion formed by the heat roller and the belt, and a decurl guide, disposed at a position downstream of the second nip portion, formed by the image forming side decurl roller and the non-image forming side decurl roller, for guiding the direction of transfer of the recording medium, whereby the recording medium is wound around the image forming side decurl roller.

The decurl guide is supported to be capable of inclining towards the heat roller, wherein the decurl guide in inclined to wind the recording medium around the decurl roller. The image forming side decurl roller has an approximately constant diameter in the direction of the image and the surface of the decurl guide has fluorine-resin layer.

The present invention also provides an image forming apparatus comprising:

means for forming an electrostatic latent image;

means for developing the electrostatic latent image;

means for transferring the developed image to a recording medium; and a fixing device for fixing the transferred image, which comprises first fixing means enclosing heating means therein; second fixing means, disposed in opposite relation to the first fixing means, for forming a first nip portion; a pair of transferring rollers, disposed downstream of the recording medium, for forming a second nip portion; a guide for biasing the recording medium discharged from the transfer rolls towards the first fixing means from the backward of one of the transferring rollers; and means for biasing the guide towards the recording medium.

In the image forming apparatus, it is preferable to provide means for adjusting the biasing angle of the guide to the image forming apparatus. Further, it is preferable to adjust the biasing angle by detecting a thickness or a weight of the recording medium. A position of the second nip portion formed by the pair of the transfer rollers with respect to the first nip portion is adjusted. The second nip portion is preferably closer to the first fixing device than is the first nip portion.

The present invention also provides a fixing device comprising a heat roller rotatably driven and having a heating member therein, a belt pressed towards the heat roller by a pressing member, an image forming side decurl roller, and a non-image forming side decurl roller, wherein the image forming side decurl roller and the non-image forming side decurl roller are disposed downstream of the nip portion formed by the heat roller and the belt, and a decurl guide for guiding the direction of winding the recording medium, wherein the decurl guide guids the recording medium to wind it around the image surface side decurl roller.

The present invention provides an image forming apparatus, which is capable of removing curling sufficiently under such a condition that a water content of recording medium such as paper is high so that curling is remarkable. And the fixing device of the invention brings about less clogging. Preferred embodiments of the present invention;

Embodiment 1

FIG. 1 shows a fixing device of one embodiment according to the present invention. The fixing device 30 comprises a heat roller 31 having an elastic layer on the surface thereof and a fixing belt which is a thin-endless belt 33 made of such as polyimide, etc. The heat roller 31 rotates by receiving a driving force, and is heated by a heating member 32 disposed in the heat roller 31.

The fixing belt 33 is pressed towards the heat roller 31 by the first pad 34, second pad 37 and pressing roller 38 to form a first nip. The first pad 34 is disposed to a pressing stay 36 by means of a pressing spring 35 for the first pad 34, and a second pad 37 is disposed to the pressing stay 36. The pressing stay 36 is pressed towards the heat roller 31 side by means of a heating mechanism (not shown). The pressing roller 38 is pressed towards the heat roller 31 side by means of a pressing mechanism (not shown). The toner image on the recording paper is fixed by fusion with heat and pressure at the first nip formed by the heat roller 31 and the fixing belt 33.

A decurl guide 41 is supported being able to incline and is pressed towards an A direction in the center by means of a pressing spring 43 for the decurl guide. A non-image side decurl guide roller 44 rotates by the driving force from a driving means.

The image side decurl roller 45 is pressed towards the non-image side decurl roller 44 by means of a pressing means (not shown) to rotate invertedly thereby to form a second nip portion.

A transfer speed of the recording paper of the non-image side decurl roller 44 is set to be 5 to 15% higher than the recording paper transfer speed of the heat roller 31. If the transfer speed of the recording paper of the non-image side decurl roller 44 is slower than the recording paper transfer speed of the heat roller 31, the recording paper may loose between the first nip portion and the second nip portion so that the image contacts the heat roller again, which leads to a hot off-set or coiling.

When the tip portion of the recording paper comes into the second nip portion, wherein the tip portion of the recording paper first comes into contact with one of the decurl rollers, the tip of the recording paper becomes to have an angle with respect to a tangential line of the decurl roller. As a result, an effective speed of the recording paper transfer becomes lower than that of the speed in the tangential direction. Therefore, even if the speed of the non-image side decurl roller 44 is the same as that of the heat roller 31, loosing of the recording paper takes place between the nip portions.

Figure 2:
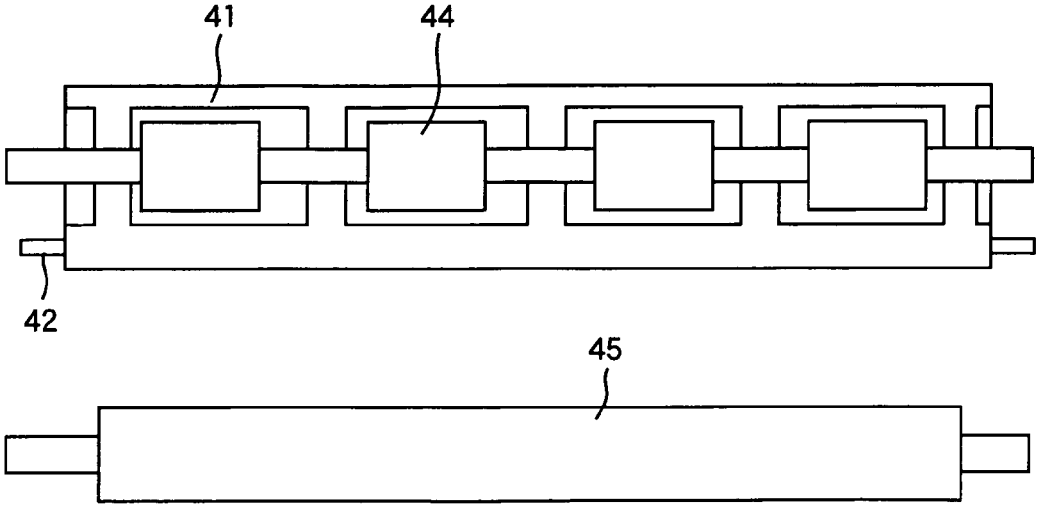
FIG. 2 shows a structure of a decurl roller and a decurl guide of a fixing device according to an embodiment.
Figure 3:
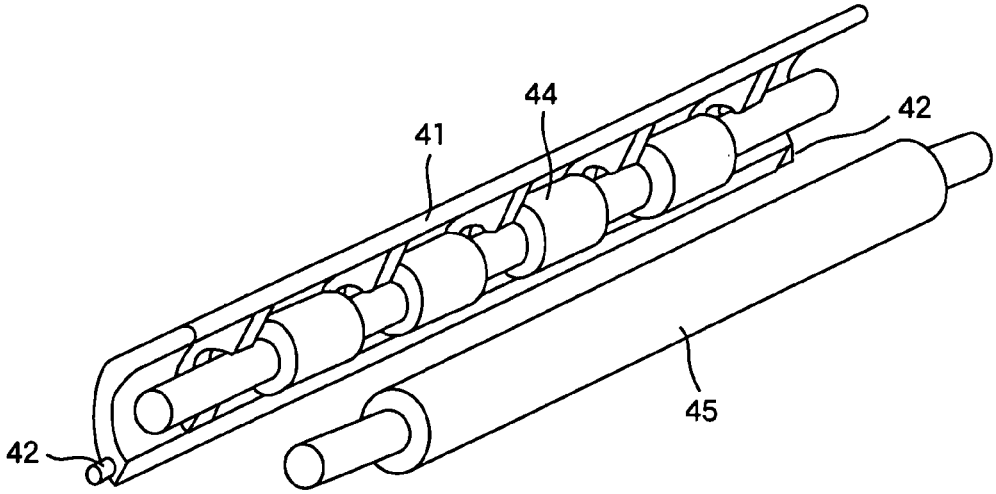
FIG. 3 is a perspective view showing a detailed structure the decurl guide of the fixing device according to the present invention.

FIGS. 2 and 3 show an arrangement of the decurl roller and decurl guide of the fixing device, wherein FIG. 2 is a plan view thereof and FIG. 3 is a perspective view. The non-image side decurl rollers 44 are arranged in the axial direction, and decurl guides 41 enter between the rolls. The guides between the divided rollers protrude until the vicinity of the second nip portion so that the recording paper is pressed towards the image side decurl roller 45 just after the second nip portion. Crook of the recording paper becomes large to increase decurl effect. The image side decurl roller 44 is covered with a fluorine-resin, which is good in peeling effect. The stain is hard to adhere to the roller and the recording paper is not blotted.

The tip of the recording paper that has passed through the nip portion is guided to the first guide 39 and the second guide 40, and then is pinched between the non-image side decurl roller 44 and the image side transfer roller 45 (this is the decurl roller, too), thereby to transfer out it from the fixing device. The recording paper is crooked in the direction (the arrow B direction in the figure) for winding around the image side decurl roller 45 by means of the decurl roller 41.

Curling of the recording paper takes place towards the belt side whose temperature is low so that the recording paper is bent in the arrow direction B in the figure to remove curling. Since the recording paper that has been heated has a high temperature and is easy to reform, the decurl effect is remarkable.

Further, since the recording paper is crooked just after the nip between the non-image side decurl roller 44 and the image side decurl roller 45, the recording paper does not bring about buckling at the time that the recording paper hits the decurl roller 41; clogging of the recording paper is hard to take place. As a result, even if the recording paper is strongly crooked by the decurl guide 41, the clogging of the recording paper does not occur. Therefore, it is possible to remove curling even in the case of the recording paper whose curling in a circumstance is remarkable.

On the other hand, if the position of the decurl guide 41 is inclined more towards the arrow direction B so as to increase an effect of decurling, the curling towards the image side may increase in the case of thick recording paper (weighing: 150g/$m^2$ or more).

Figure 4:
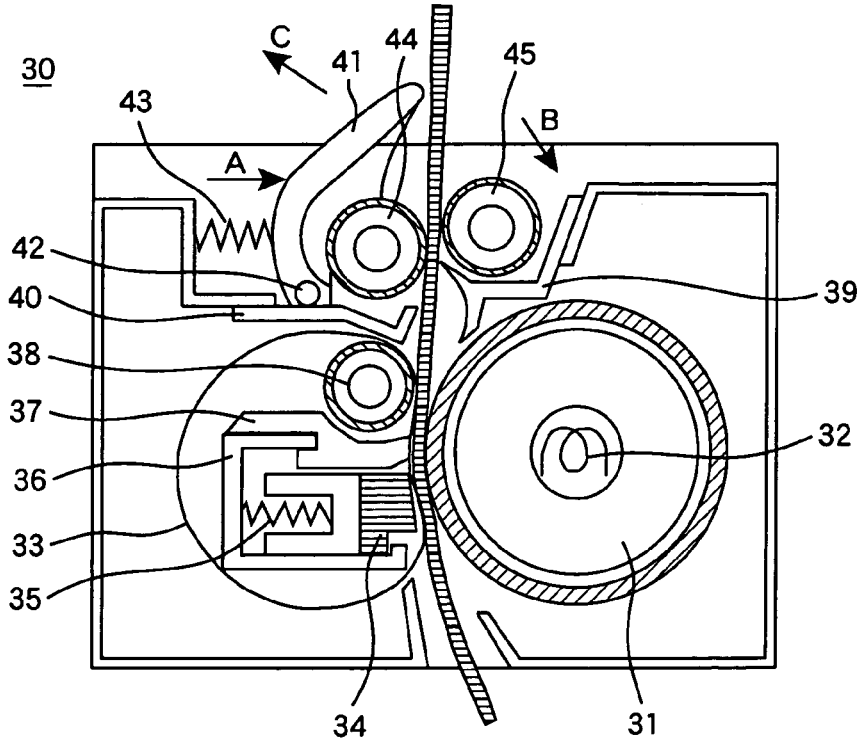
FIG. 4 is a side cross sectional view showing that a thick recording medium passes through the fixing device according to the first embodiment.
Figure 5:
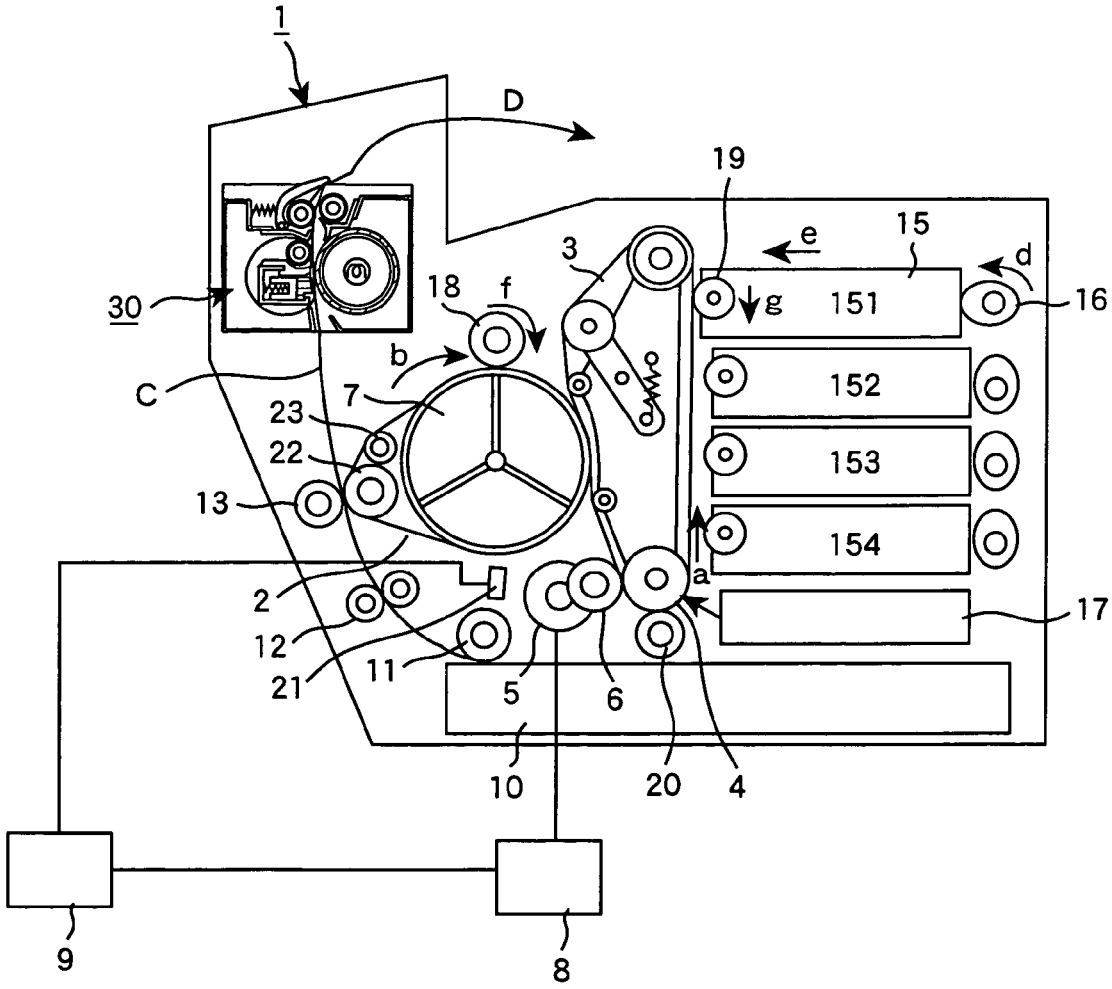
FIG. 5 is an image forming apparatus using the fixing device according to the first embodiment.

FIG. 4 shows a mechanism of the decurl guide 41 at the time when a thick recording paper (weighing: 150 g/$cm^2$ or more) is supplied to the fixing device according to the present embodiment. The decurl guide 41 is supported to be able to incline, and the guide 41 is pressed towards the arrow A direction in the figure by means of the pressing spring 43; the decurl guide 41 is inclined towards the arrow C direction in the figure by the effect of the stiffness of the thick recording paper to lessen the winding angle in the image side decurl roller 45 so that curling in the image side does not increase. FIG. 5 shows a side elevational view of an image forming apparatus 1 that utilizes the fixing device according to the present embodiment. In this apparatus, an intermediate transfer belt 2 is rotated 4 times so as to impose four colors of images to produce color images, which is a so-called a color laser printer.

In the following, units arranged in the apparatus 1 are explained. A photosensitive belt 3 is moved to the arrow direction a by means of a driving roller 4, which is driven by a driving motor 5 through a motor driving system 6. The intermediate belt 2 is driven by a transfer force of the nip portion n that is in contact with the photosensitive belt 3. The photosensitive belt 4 comprises a base member made of polycarbonate resin, polyethyrene terephthalate or polyimide resin, a conductive layer and a photosensitive layer. A thickness of the photosensitive layer is preferably 0.075 to 0.15 mm. The intermediate belt 2 is a seamless belt made of polycarbonate, polyethyrene terephthalate or polyimide resin, is given semiconductivity and has a volume resistivity of 108 to loll Q cm. Its thickness is preferably 0.075 to 0.15 mm.

The intermediate belt 2 is hung over the photosensitive member side roller 7 and the transfer side roller 22, and the photosensitive belt 3 is wound around the photosensitive member side roller 7 by means of the intermediate transfer belt 2. The photosensitive member side roller 7 has a large diameter and a nip width with the photosensitive belt is made 20 mm or more. The transfer side roller 22 has a smaller diameter than that of the transfer side roller 22.

The intermediate transfer belt tension roller 23 is means for imparting tension to the intermediate transfer belt 2, wherein the intermediate transfer belt 2 is pushed by means of a spring, etc. The driving motor 5 is controlled by a motor driver so as to maintain a constant speed of the motor 5. The intermediate belt 2 has a marker by which a sensor 21 can detect its passage. The signal is read out by a calculating means 9 to give the motor driver 8 an instruction so as to transfer the intermediate transfer belt at a constant speed.

A developing unit 15 as an image forming means stores toner and forms a thin toner layer on the surface of the developing roller 19. When a toner image is formed on the photosensitive belt 3, a retract means 16 is rotated in the direction of an arrow d to advance the developing unit 15 in the direction e and the developing roller 19 is brought into contact with the photosensitive belt 3. After image forming, the retract means 16 is rotated in the arrow direction d to separate the developing unit 15.

A fur brush 18 for eliminating means makes a contact with the intermediate transfer belt to remove remaining toner thereon after the toner image is transferred to the recording paper by means of the retract means (not shown), and then separates. The transfer roller 13 as the transfer means presses the recording paper towards the intermediate transfer belt 2 in the transfer step by means of the retracting means (not shown) and after the recording paper passes through the transfer roller 13, the transfer roller separates.

A recording paper storing cassette 10 is placed almost horizontally with respect to the plane where the apparatus is placed at the lower position of the apparatus. The recording paper cassette 10, a pickup roller 11, a resist roller 12, a transfer roller 13 and a fixer 30 are arranged on the recording paper transfer passage c. The recording paper transfer passage c, the intermediate transfer belt 2, the photosensitive belt 3 and the developing unit 15 are arranged in order. Next, the image forming process is explained. When an image is formed, the photosensitive layer of the photosensitive belt is charged with the fur brush 20. Then, laser light in accordance with images is directed to the photosensitive layer from a laser optical unit 17 to remove a potential. A developing roller 19 while rotating is brought into contact with the photosensitive belt 3 to form a toner image according to the image on the photosensitive belt 3.

In this example, a rotating direction of the developing roller is in a g direction, which is the same direction as that of the photosensitive belt, so as to form homogeneous toner images. A circumferential speed of the developing roller is set to be higher than that of the photosensitive belt 3. The toner image on the photosensitive belt 3 is transferred temporarily to the intermediate transfer belt 2. In a color laser printer, there are four colors developing units 151, 152, 153 and 154 of black, yellow, magenta and cyan; each of the mono color images formed on the photosensitive belt 3 is superimposed on the intermediate transfer belt 2 to produce a color image.

The recording paper stored in the recording paper cassette 10 is sent page-by-page by means of a pickup roller 11 and skew is corrected by means of a resist roller 12. Before the tip of recording paper arrives at the position between the transfer roller 3 and the intermediate transfer belt 2, the transfer roller 13 is pressed towards the intermediate transfer belt 2 by means of the retract means (not shown) and the recording paper is pressed towards the intermediate transfer belt 2. At the same time, a high potential is applied to the transfer roller 13 and the toner image on the intermediate transfer belt 2 is transferred to the recording paper. Thereafter, the recording paper arrives at the fixing device 30 so that the toner image on the paper is fixed by heat and pressure.

Remaining images on the intermediate transfer belt 2 after image transfer is removed by contacting the fur brush 18 with the intermediate transfer belt 2, while the brush is rotating. In order to increase the removal performance of images, the rotating direction shown by an arrow f of the fur brush is set to be opposite to the rotating direction of the intermediate transfer belt in this example.

In the image forming apparatus according to this example, it is possible to sufficiently remove curling and there is little of possibility of paper clogging, even when a water content is high, which leads to a remarkable curling. Further, since decurl performance appropriately changes in accordance with stiffness of paper, it is possible to remove curling of from thin paper to thick paper.

One of the examples of an image forming apparatus comprises a heat roller having a heating member, which is driven and rotated, a belt pressed towards the heat roller by means of a pressing member, an image side decurl roller and a non-image side decurl roller, the decurl rollers being disposed in opposite relation at a downstream of a nip portion formed by the heat roller and the belt. A decurl guide is disposed at a downstream of a nip portion formed by the decurl rollers, the decurl guide guiding the transfer direction of the recording paper so as to wind it around the image side decurl roller, thereby to remove curling.

In the above examples, although there are shown the heat roller as the first fixing roller and the belt as the second fixing means, it may be possible to utilize other embodiments within the spirit of the present invention. For example, the first fixing means may be a roller having a heating member therein and the second fixing means may be a roller having no heating member. The first fixing means may be a belt having a heating member therein.

What is claimed is:

1. A fixing device comprising a first fixing means having a heating means disposed therein, a second fixing means, disposed to oppose to the first fixing means, for pinching a recording medium to form a first nip portion, a pair of transfer rollers, disposed at a downstream side of the recording medium with regard to a conveying direction of the recording medium, for forming a second nip portion, a guide for biasing the recording medium discharged from the transfer rollers towards the first fixing means side from one of the transfer rollers, means for biasing the guide towards the recording medium side, and means for adjusting a biasing angle of the guide.

2. The fixing device according to claim 1, wherein the means for adjusting the biasing angle of the guide detects a weight or a thickness of the recording medium.

3. The fixing medium according to claim 1, which further comprises means for adjusting a position of the second nip portion, formed by the pair of transfer rollers, with respect to the first nip portion.

4. The fixing device according to claim 1, wherein the second nip portion is located at a position closer to the first fixing means than the first nip portion.

5. A fixing device comprises a heat roller having a heating element therein and driven rotatably, a belt pressed by a pressure member towards the heat roller, an image forming side decurl roller, a non-image side decurl roller, the decurl rollers being disposed to oppose to each other at a position downstream from a first nip portion formed by the heat roller and the belt, and a decurl guide, disposed at a position downstream of a second nip portion, formed by the image forming side decurl roller and the non-image forming side decurl roller, for guiding the direction of transfer of the recording medium, whereby the recording medium is wound around the image forming side decurl roller.

6. The fixing device according to claim 5, wherein the decurl guide is supported to be capable of being so inclined as to wind on the image forming side decurl roller with respect to the heat roller.

7. The fixing device according to claim 5, wherein the image forming side decurl roller has a constant diameter in a direction of a width of the image and has a fluorine-resin layer.

8. An image forming apparatus comprising:

means for forming a electrostatic latent image;

means for developing the electrostatic latent image;

means for transferring the developed image to a recording medium; and a fixing device for fixing the transferred image, which comprises first fixing means enclosing heating means therein; second fixing means, disposed in opposite position to the first fixing means, for forming a first nip portion; a pair of transferring rollers, disposed downstream of the recording medium with regard to a conveying direction of the recording medium, for forming a second nip portion; a guide for biasing the recording medium discharged from the transfer rolls towards the first fixing means from the backward of one of the transferring rolls; means for biasing the guide towards the recording medium, and means for adjusting a biasing angle of the guide.

9. The image forming apparatus to claim 8, the means for adjusting the angle of the guide detects a weight or a thickness of the recording medium.

10. The image forming apparatus according to claim 8, which further comprises means for adjusting a position of the first nip portion formed by the pair of the transferring rollers with respect to the position of the first nip portion.

11. The image forming apparatus according to claim 8, wherein the second nip portion is located at a position closer to the first fixing means side than is the first nip portion.

* * * * *